US010595558B2

(12) United States Patent
Malgat et al.

(10) Patent No.: US 10,595,558 B2
(45) Date of Patent: Mar. 24, 2020

(54) SMOKING ARTICLE COMPRISING A WRAPPER WITH A PLURALITY OF PROJECTIONS PROVIDED ON AN INNER SURFACE THEREOF

(71) Applicant: Philip Morris Products S.A., Neuchatel (CH)

(72) Inventors: Alexandre Malgat, Les Tuileries de Grandson (CH); Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/559,483

(22) PCT Filed: Mar. 30, 2016

(86) PCT No.: PCT/EP2016/056968
§ 371 (c)(1),
(2) Date: Sep. 19, 2017

(87) PCT Pub. No.: WO2016/156437
PCT Pub. Date: Oct. 6, 2016

(65) Prior Publication Data

US 2018/0116275 A1 May 3, 2018

(30) Foreign Application Priority Data

Mar. 31, 2015 (EP) ..... 15162077

(51) Int. Cl.
*A24D 1/02* (2006.01)
*A24F 47/00* (2020.01)

(52) U.S. Cl.
CPC ..... *A24D 1/02* (2013.01); *A24F 47/006* (2013.01)

(58) Field of Classification Search
CPC ... B31D 5/02; A24D 1/00; A24D 1/02; A24D 1/042; D21H 5/16; A24F 47/002; A24F 47/008
(Continued)

(56) References Cited

U.S. PATENT DOCUMENTS 3,228,402 A * 1/1966 Lebert ..... A24D 1/02 131/336
3,606,892 A * 9/1971 Wilson ..... A24D 1/02 131/336
(Continued)

FOREIGN PATENT DOCUMENTS

CN 103037718 A 4/2013
DE 10 2007 026 979 A1 4/2008
(Continued)

OTHER PUBLICATIONS

International Search Report and Written Opinion dated Jun. 17, 2016 in PCT/EP2016/056968, filed Mar. 30, 2016.
(Continued)

*Primary Examiner* — Hae Moon Hyeon
(74) *Attorney, Agent, or Firm* — Oblon, McClelland, Maier & Neustadt, L.L.P.

(57) ABSTRACT

A smoking article is provided, including a combustible heat source; an aerosol-forming substrate downstream of the combustible heat source; and a wrapper circumscribing at least a rear portion of the combustible heat source and at least a front portion of the aerosol-forming substrate, wherein a plurality of inwardly extending projections are disposed on an inner surface of the wrapper overlying the combustible heat source, and the plurality of inwardly extending projections cover between about 10 percent and about 70 percent of a surface area of the inner surface of the wrapper overlying the combustible heat source.

15 Claims, 3 Drawing Sheets

(58) Field of Classification Search
USPC ..... 131/365, 361, 328, 329
See application file for complete search history.

(56) References Cited

U.S. PATENT DOCUMENTS

| | | | | |
|---|---|---|---|---|
| 5,040,551 | A | 8/1991 | Schlatter et al. | |
| 8,061,361 | B2 * | 11/2011 | Maeder | A24F 47/006 131/270 |
| 8,816,217 | B2 | 8/2014 | Zheng et al. | |
| 8,915,255 | B2 * | 12/2014 | Poget | A24B 15/165 131/365 |
| 2002/0053350 | A1 * | 5/2002 | Tani | A24D 1/02 131/360 |
| 2007/0215168 | A1 | 9/2007 | Banerjee et al. | |
| 2010/0083959 | A1 | 4/2010 | Siller | |
| 2011/0271972 | A1 * | 11/2011 | Thomas | A24B 15/165 131/365 |
| 2013/0019888 | A1 * | 1/2013 | Tsuruizumi | A24B 15/165 131/331 |
| 2013/0133675 | A1 * | 5/2013 | Shinozaki | A24F 47/006 131/329 |
| 2013/0139837 | A1 | 6/2013 | Kaljura et al. | |
| 2013/0199551 | A1 * | 8/2013 | Le Roux | A24C 5/471 131/284 |
| 2014/0345634 | A1 * | 11/2014 | Zuber | A24F 47/004 131/329 |
| 2016/0073687 | A1 | 3/2016 | Banerjee et al. | |
| 2016/0295917 | A1 * | 10/2016 | Malgat | A24F 47/008 |
| 2017/0303585 | A1 * | 10/2017 | Florack | A24F 47/006 |

FOREIGN PATENT DOCUMENTS

| | | | |
|---|---|---|---|
| EP | 2 550 879 | A1 | 1/2013 |
| EP | 2 801 272 | A2 | 11/2014 |
| GB | 2 479 775 | A | 10/2011 |
| JP | 5483504 | B2 | 5/2014 |
| RU | 2012 149 550 | A | 5/2014 |
| WO | WO 2008/043474 | A1 | 4/2008 |
| WO | WO 2009/022232 | A2 | 2/2009 |
| WO | WO 2009/074870 | A2 | 6/2009 |
| WO | WO 2012/164077 | A1 | 12/2012 |
| WO | WO 2014/086998 | A1 | 6/2014 |
| WO | WO 2015/022321 | A1 | 2/2015 |

OTHER PUBLICATIONS

Russian Notice of Allowance and Search Report with English translation dated Aug. 29, 2019 in corresponding Russian Patent Application No. 2017134601, (17 pages).

Chinese Office Action and Search Report with English translation dated Oct. 28, 2019 in corresponding Chinese Patent Application No. 201680016291.0, (13 pages).

* cited by examiner

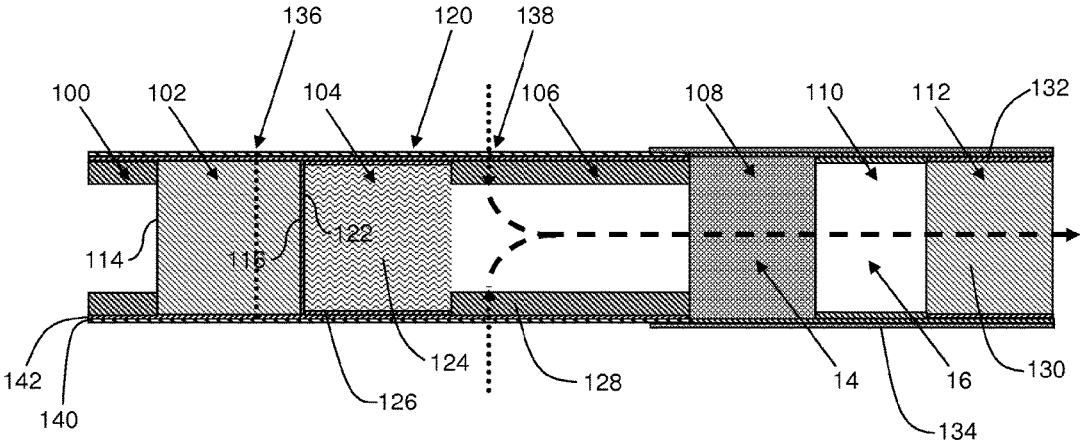
Figure 1
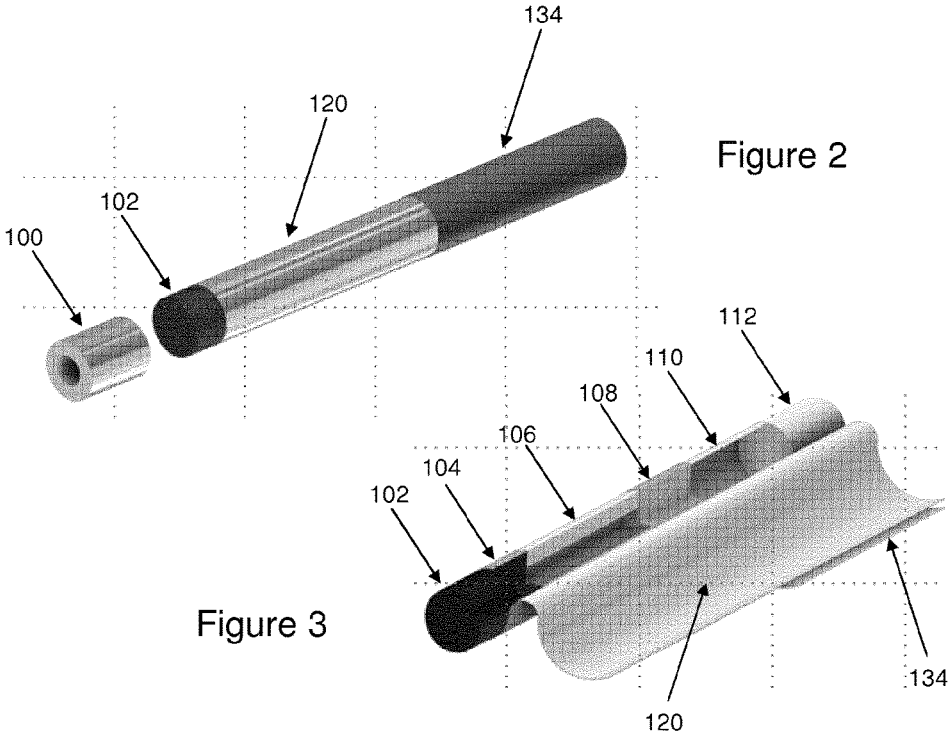
Figure 2
Figure 3

SMOKING ARTICLE COMPRISING A WRAPPER WITH A PLURALITY OF PROJECTIONS PROVIDED ON AN INNER SURFACE THEREOF

TECHNICAL FIELD

The present invention relates to a smoking article comprising a combustible heat source, an aerosol-forming substrate downstream of the combustible heat source and a wrapper circumscribing at least a rear portion of the combustible heat source and at least a front portion of the aerosol-forming substrate.

DESCRIPTION OF THE RELATED ART

A number of ways of retaining combustible heat sources in position within heated smoking articles have proposed in the art. For example, EP-A1-2 550 879 discloses a smoking article comprising a multilayered tube member including at least one metal layer and one paper layer, a carbon heat source arranged in an end portion of the tube member to be at least partly in direct close contact with an inner surface of the tube member, the carbon heat source emitting heat when ignited, a smoking flavor releasing source arranged in the tube member to adjoin the carbon heat source, and a holder part keeping the carbon heat source in direct contact with said end portion and holding the carbon heat source against said end portion. In the embodiment shown in FIG. 4 the holder part has a plurality of axial projections on the inner surface that extend axially on the inner surface of the holder part. EP-A1-2 550 879 discloses that the holder part with such axial projections can more reliably hold the carbon heat source. However, in the embodiment shown in FIG. 4 of EP-A1-2 550 879, the axial projections are provided on only a small portion of the inner surface of the holder part and are of considerable height relative to the inner surface of the holder part. As a result, air gaps between the remainder of the inner surface of the holder part and the carbon heat source may adversely affect conductive heat transfer from the carbon heat source to the smoking flavor releasing source by the at least one metal layer of the multilayered tube member and hence the performance of the smoking article.

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

It is known to include a heat-conducting element around and at least a rear portion of the combustible heat source and at least a front portion of the aerosol-forming substrate of the heated smoking article in order to ensure sufficient conductive heat transfer from the combustible heat source to the aerosol-forming substrate to obtain an acceptable aerosol. For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. The heat-conducting element and the aerosol-generating substrate are circumscribed by an outer wrapper of cigarette paper. In use, the front portion of the aerosol-forming substrate is heated by conduction through the abutting rear portion of the combustible heat source and the heat-conducting element.

In smoking articles in which tobacco is heated rather than combusted, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to a user. In smoking articles comprising a combustible heat source and an aerosol-forming substrate located downstream of the combustible heat source, movement of the combustible heat source relative to the aerosol-forming substrate during use of the smoking article may cause the temperature of the aerosol-forming substrate to drop outside of a desired range, thereby impacting the performance of the smoking article. If the temperature of the aerosol-forming substrate drops too low, for instance, it may adversely impact the consistency and the amount of aerosol delivered to a user.

A number of ways of retaining combustible heat sources in position within heated smoking articles have proposed in the art. For example, EP-A1-2 550 879 discloses a smoking article comprising a multilayered tube member including at least one metal layer and one paper layer, a carbon heat source arranged in an end portion of the tube member to be at least partly in direct close contact with an inner surface of the tube member, the carbon heat source emitting heat when ignited, a smoking flavor releasing source arranged in the tube member to adjoin the carbon heat source, and a holder part keeping the carbon heat source in direct contact with said end portion and holding the carbon heat source against said end portion. In the embodiment shown in FIG. 4 the holder part has a plurality of axial projections on the inner surface that extend axially on the inner surface of the holder part. EP-A1-2 550 879 discloses that the holder part with such axial projections can more reliably hold the carbon heat source. However, in the embodiment shown in FIG. 4 of EP-A1-2 550 879, the axial projections are provided on only a small portion of the inner surface of the holder part and are of considerable height relative to the inner surface of the holder part. As a result, air gaps between the reminder of the inner surface of the holder part and the carbon heat source may adversely affect conductive heat transfer from the carbon heat source to the smoking flavor releasing source by the at least one metal layer of the multilayered tube member and hence the performance of the smoking article.

It would be desirable to provide a heated smoking article in which retention of the combustible heat source is improved with no or reduced adverse impact on conductive heat transfer from the combustible heat source to the aerosol-forming substrate and hence the performance of the smoking article.

SUMMARY

According to the invention there is provided a smoking article comprising: a combustible heat source; an aerosol-forming substrate downstream of the combustible heat source; and a wrapper circumscribing at least a rear portion of the combustible heat source and at least a front portion of the aerosol-forming substrate, wherein a plurality of inwardly extending projections are provided on an inner surface of the wrapper overlying the combustible heat source, and wherein the plurality of inwardly extending projections cover between about 10 percent and about 70 percent of the surface area of the inner surface of the wrapper overlying the combustible heat source.

BRIEF DESCRIPTION OF THE DRAWINGS

The invention will be further described, by way of example only, with reference to the accompanying drawings in which:

FIG. 1 shows a schematic longitudinal cross-sectional view of an embodiment of a smoking article according to the invention;

FIG. 2 shows a schematic perspective view of the smoking article of FIG. 1 after the cap has been removed to expose the front end face of the combustible heat source;

FIG. 3 shows a schematic perspective view of the smoking article of FIG. 2, in which the wrapper and tipping paper is partially unwrapped to show underlying components of the smoking article;

DETAILED DESCRIPTION

Figure 4:
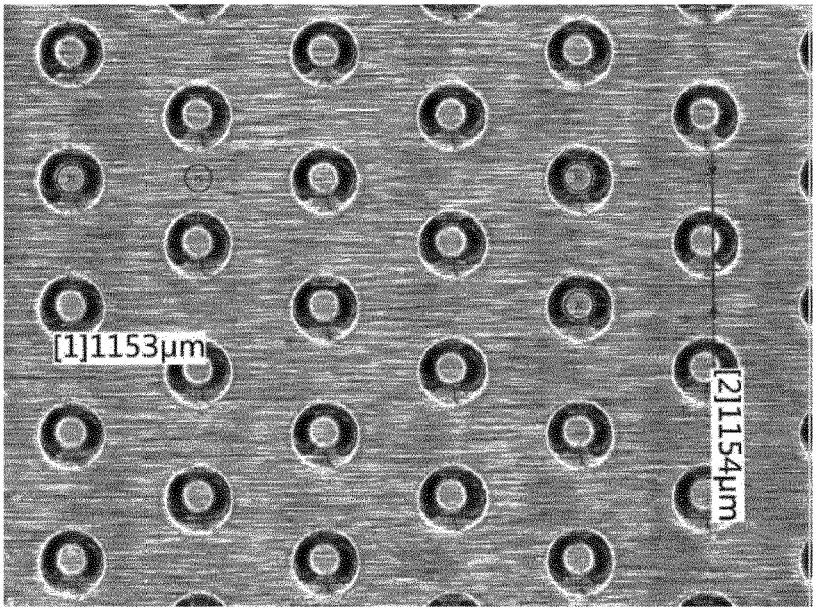
FIG. 4 shows an image of the wrapper of Example 2 obtained using an optical microscope with high magnification.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the terms 'distal', 'upstream' and 'front', and 'proximal', 'downstream' and 'rear', are used to describe the relative positions of components, or portions of components, of the smoking article. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end of the smoking article. The mouth end of the smoking article is downstream of the distal end of the smoking article. The proximal end of the smoking article may also be referred to as the downstream end of the smoking article and the distal end of the smoking article may also be referred to as upstream end of the smoking article. Components, or portions of components, of smoking articles according to the invention may be described as being upstream or downstream of one another based on their relative positions between the proximal end of the smoking article and the distal end of the smoking article.

The combustible heat source has a front end face and an opposed rear end face. The front end face of the combustible heat source is at the upstream end of the combustible heat source. The upstream end of the combustible heat source is the end of the combustible heat source furthest from the proximal end of the smoking article. The rear end face of the combustible heat source is at the downstream end of the combustible heat source. The downstream end of the combustible heat source is the end of the combustible heat source closest to the proximal end of the smoking article.

As used herein, the term 'longitudinal' is used to describe the direction between the proximal end and the opposed distal end of the smoking article.

As used herein, the term 'length' is used to describe the maximum dimension of components of the smoking article in the longitudinal direction of the smoking article. That is, the maximum dimension in the direction between the proximal end and the opposed distal end of the smoking article.

As used herein, the term 'radial' is used to describe the direction perpendicular to the longitudinal direction. That is, the direction perpendicular to the direction between the proximal end and the opposed distal end of the smoking article.

As used herein, the term 'diameter' is used to describe the maximum dimension of components of the smoking article in the radial direction of the smoking article.

As used herein, the terms 'inner surface' and 'outer surface' are used to describe the radially innermost surface and radially outermost surface, respectively, of components of the smoking article.

As described further below, advantageously the plurality of inwardly extending projections provided on the inner surface of the wrapper overlying the combustible heat source help to retain the combustible heat source in position within the smoking article by directly or indirectly gripping the combustible heat source.

As used herein, the terms 'grip' and 'gripping' are used to describe holding a component of the smoking article such that relative movement between that component and other components of the smoking article is resisted.

The plurality of inwardly extending projections cover between about 10 percent and about 70 percent of the surface area of the inner surface of the wrapper overlying the combustible heat source. The percentage of the surface area of the inner surface of the wrapper overlying the combustible heat source that is covered by the plurality of inwardly extending projections is given by:

$$Percentagecoverage = \frac{\sum Footprint_{projection}}{Surface\ \ Area_{wrapper}} \times 100,$$

where Surface $Area_{wrapper}$ is the total surface area of the inner surface of the wrapper overlying the combustible heat source and $Footprint_{projection}$ is the cross-sectional area of the base of each of the plurality of inwardly extending projections provided on the inner surface of the wrapper overlying the combustible heat source as measured by image processing of images obtained using an optical microscope with high magnification.

Advantageously, direct or indirect contact between the plurality of inwardly extending projections provided on the inner surface of the wrapper and the combustible heat source helps to maintain sufficient conductive heat transfer from the combustible heat source to the aerosol-forming substrate to achieve satisfactory performance of the smoking article.

Preferably, the plurality of inwardly extending projections cover between about 20 percent and about 65 percent of the surface area of the inner surface of the wrapper overlying the combustible heat source.

The height of each of the plurality of inwardly extending projections is preferably less than or equal to about 300 microns, more preferably less than or equal to about 100 microns, most preferably less than or equal to about 80 microns as measured by image processing of images obtained using an optical microscope with high magnification.

As used herein, the term 'height' is used to describe the inward extent of the plurality of inwardly extending projections in a direction perpendicular to the inner surface of the wrapper.

The height of each of the plurality of inwardly extending projections is preferably greater than or equal to about 10 microns, more preferably greater than or equal to about 20 microns, most preferably greater than or equal to about 40 microns.

The height of each of the plurality of inwardly extending projections may be between about 10 microns and about 300 microns, between about 10 microns and about 100 microns or between about 10 microns and about 80 microns.

For example, the height of each of the plurality of inwardly extending projections may be between about 20 microns and about 300 microns, between about 20 microns and about 100 microns or between about 20 microns and about 80 microns. In certain embodiments, the height of each of the plurality of inwardly extending projections may be between about 40 microns and about 300 microns, between about 40 microns and about 100 microns or between about 40 microns and about 80 microns.

The maximum cross-sectional area of each of the plurality of inwardly extending projections is preferably between about 100 square microns and about 0.35 square millimetres as measured by image processing of images obtained using an optical microscope with high magnification. In certain embodiments, the maximum cross-sectional area of each of the plurality of inwardly extending projections is between about 0.01 square millimetres and about 0.3 square millimetres.

The separation between adjacent inwardly extending projections provided on the inner surface of the wrapper is preferably greater than or equal to about 20 microns, more preferably greater than or equal to about 50 microns as measured by image processing of images obtained using an optical microscope with high magnification.

As used herein, the term 'separation' is used to describe the minimum distance between the bases of adjacent inwardly extending projections provided on the inner surface of the wrapper.

The separation between adjacent inwardly extending projections provided on the inner surface of the wrapper is preferably less than or equal to about 1.5 millimetres, more preferably less than or equal to about 1 millimetre.

The separation between adjacent inwardly extending projections provided on the inner surface of the wrapper may be between about 10 microns and about 1.5 millimetres or between about 10 microns and about 1 millimetre. In certain embodiments, the separation between adjacent inwardly extending projections provided on the inner surface of the wrapper may be between about 50 microns and about 1.5 millimetres or between about 50 microns and about 1 millimetre.

The plurality of inwardly extending projections may be provided on the inner surface of the wrapper in a regular pattern.

As used herein, the term 'regular pattern' is used to describe a pattern comprising a regular array of inwardly extending projections.

For example, plurality of inwardly extending projections may be provided on the inner surface of the wrapper in a regular striped pattern, a regular checked or square pattern, a regular hexagonal pattern or any other regular geometric pattern.

Alternatively, the plurality of inwardly extending projections may be provided on the inner surface of the wrapper in an irregular pattern.

As used herein, the term 'irregular pattern' is used to describe a pattern comprising a non-repetitive or random array of inwardly extending projections.

The plurality of inwardly extending projections are preferably on the inner surface of the wrapper overlying the combustible heat source in a pattern having a density of at least about 0.5 inwardly extending projections per square millimetre, For example, in certain embodiments the plurality of inwardly extending projections may be provided on the inner surface of the wrapper overlying the combustible heat source in a pattern having a density of at least about 0.75 inwardly extending projection per square millimetre, at least about 1 inwardly extending projection per square millimetre or at least about 2 inwardly extending projections per square millimetre.

The plurality of inwardly extending projections provided on the inner surface of the wrapper overlying the combustible heat source may be in direct contact with the combustible heat source. Advantageously, in such embodiments the plurality of inwardly extending projections directly grip the combustible heat source and thereby help to retain the combustible heat source within the smoking article.

Alternatively, the plurality of inwardly extending projections provided on the inner surface of the wrapper overlying the combustible heat source may be radially separated from the combustible heat source by one or more intermediate components.

As used herein, the term 'radially separated' is used to mean that the plurality of inwardly extending projections are spaced apart from the combustible heat source in a radial direction, such that there is no direct contact between the plurality of inwardly extending projections and the combustible heat source.

For example, the plurality of inwardly extending projections provided on the inner surface of the wrapper may be radially separated from the combustible heat source by one or more intervening layers of adhesive, heat-conductive material (such as aluminium), heat-insulative material (such as paper), other wrapping material or a combination thereof.

In certain embodiments, the plurality of inwardly extending projections provided on the inner surface of the wrapper may be radially separated from the combustible heat source by one or more intermediate components that are adhered or otherwise attached to the combustible heat source.

For example, the plurality of inwardly extending projections provided on the inner surface of the wrapper may be radially separated from the combustible heat source by one or more intervening layers of adhesive, heat-conductive material (such as aluminium), heat-insulative material (such as paper), other wrapping material or a combination thereof.

Advantageously, in such embodiments the plurality of inwardly extending projections directly grip the one or more intermediate components attached to the combustible heat source. The plurality of inwardly extending projections thereby indirectly grip the combustible heat source and help to retain the combustible heat source in within the smoking article.

The wrapper circumscribes at least a rear portion of the combustible heat source and at least a front portion of the aerosol-forming substrate. The plurality of inwardly extending projections are provided on an inner surface of the wrapper overlying at least a portion of the combustible heat source so that the plurality of inwardly extending projections directly or indirectly grip the combustible heat source. The length of the inner surface of the wrapper overlying the combustible heat source on which the plurality of projections are provided and, thus, the length of the combustible heat source that is directly or indirectly gripped by the plurality of inwardly extending projections may vary according to the specific arrangement of the plurality of inwardly extending projections and the smoking article.

The plurality of inwardly extending projections are preferably provided on an inner surface of the wrapper overlying at least about 25 percent of the length of the combustible heat source, more preferably at least about 30 percent of the combustible heat source. In other words, the length of the inner surface of the wrapper overlying the combustible heat source on which the plurality of projections are provided is preferably such that at least 25 percent of the length of the combustible heat source is directly or indirectly gripped by the plurality of inwardly extending projections, more preferably such that at least 30 percent of the length of the combustible heat source is directly or indirectly gripped by the plurality of inwardly extending projections.

The plurality of projections may be provided on the inner surface of the wrapper overlying the combustible heat source such that the combustible heat source is directly or indirectly gripped by the plurality of inwardly extending projections along a single portion of the length of the combustible heat source. For example, the plurality of projections may be provided on the inner surface of the wrapper overlying the combustible heat source such that the combustible heat source is directly or indirectly gripped by the plurality of inwardly extending projections along a single portion of the length of the combustible heat source extending from the rear end face of the combustible heat source to a position along the length of the combustible heat source at least about 25 percent or at least about 30 percent of the distance between the rear end face and the front end face of the combustible heat source.

Alternatively, the plurality of projections may be provided on the inner surface of the wrapper overlying the combustible heat source such that the combustible heat source is directly or indirectly gripped by the plurality of inwardly extending projections along two or more longitudinally spaced apart portions of the length of the combustible heat source. For example, the plurality of projections may be provided on the inner surface of the wrapper overlying the combustible heat source such that the combustible heat source is directly or indirectly gripped by the plurality of inwardly extending projections along two or more longitudinally spaced apart portions of the length of the combustible heat source that in combination have a length of at least 25 percent or at least about 30 percent of the length of the combustible heat source.

The plurality of projections are preferably provided on the inner surface of the wrapper overlying the combustible heat source such that the combustible heat source is directly or indirectly gripped by the plurality of inwardly extending projections around the entire circumference of the combustible heat source. In such embodiments, the plurality of projections may form one or more rings around the combustible heat source.

However, the plurality of projections may alternatively be provided on the inner surface of the wrapper overlying the combustible heat source such that the combustible heat source is directly or indirectly gripped by the plurality of inwardly extending projections around only part of the circumference of the combustible heat source.

The plurality of inwardly extending projections may have any suitable shape.

The cross-sectional area of the base of each of the plurality of inwardly extending projections is preferably greater than the cross-sectional area of the tip of each of the plurality of inwardly extending projections.

The plurality of inwardly extending projections may have a sharp or pointed tip. For example, the plurality of inwardly extending projections may be conical or pyramidal.

Alternatively, the plurality of inwardly extending projections may have a substantially flat or curved tip. For example, the plurality of inwardly extending projections may be hemispherical, conical frustums or pyramidal frustums.

The plurality of inwardly extending projections may extend radially inwardly.

Alternatively, one or more of the plurality of inwardly extending projections may extend inwardly towards the downstream end of the smoking article. That is, one or more of the plurality of inwardly extending projections may extend inwardly such that its tip is downstream of its base. Advantageously, in such embodiments the one or more projections that extend inwardly towards the downstream end of the smoking article may act as barbs to increase resistance against upstream movement of the combustible heat source.

Alternatively or in addition, one or more of the plurality of inwardly extending projections may extend inwardly towards the upstream end of the smoking article. That is, one or more of the plurality of inwardly extending projections may extend inwardly such that its tip is upstream of its base. Advantageously, in such embodiments the one or more projections that extend inwardly towards the upstream end of the smoking article may act as barbs to increase resistance against downstream movement of the combustible heat source.

The plurality of inwardly extending projections may be integral with the wrapper. In such embodiments, the plurality of inwardly extending projections may be formed by deforming the wrapper. For example, the plurality of inwardly extending projections may be formed by embossing, stamping or pressing the wrapper.

Alternatively, the plurality of inwardly extending projections may alternatively be non-integral with the wrapper. In such embodiments, the plurality of inwardly extending projections may be adhered or otherwise attached directly or indirectly to the inner surface of the wrapper.

In certain preferred embodiments, the plurality of inwardly extending projections are integral with the wrapper and are formed by deforming the wrapper.

In certain particularly preferred embodiments, the plurality of inwardly extending projections are integral with the wrapper and are formed by embossing the wrapper. In such embodiments, the plurality of inwardly extending projections may for example be formed by pin-up/pin-up embossing, shadow embossing or waffle embossing wrapper.

Smoking articles according to the invention may only comprise a plurality of inwardly extending projections on an inner surface of the wrapper overlying the combustible heat source.

Alternatively, smoking articles according to the invention may also further comprise a plurality of inwardly extending projections on an inner surface of the wrapper overlying the aerosol-forming substrate.

Advantageously the plurality of inwardly extending projections provided on the inner surface of the wrapper overlying the aerosol-forming substrate help to retain the aerosol-forming substrate in position within the smoking article by directly or indirectly gripping the aerosol-forming substrate.

The plurality of inwardly extending projections provided on the inner surface of the wrapper overlying the combustible heat source may be in direct contact with the aerosol-forming substrate.

Alternatively, the plurality of inwardly extending projections provided on the inner surface of the wrapper overlying the aerosol-forming substrate may be radially separated from the aerosol-forming substrate by one or more intermediate components.

Optional and preferred features described above in relation to the plurality of inwardly extending projections provided on the inner surface of the wrapper overlying the combustible heat source may similarly apply to the plurality of inwardly extending projections provided on the inner surface of the wrapper overlying the aerosol-forming substrate.

The wrapper may be formed from any suitable material.

The wrapper may comprise one or more layers of heat-insulative material, one or more layers of heat-conductive material or any combination thereof.

Suitable heat-conductive materials include, but are not limited to: metals such as, for example, aluminium, steel, iron and copper; and metal alloys. Suitable heat-insulative materials include, but are not limited to, paper, ceramics and metal oxides.

In certain embodiments the wrapper is formed of a laminate material comprising one or more layers of heat-conductive material and one or more layers of heat-insulative material.

In certain preferred embodiments the wrapper is formed of a laminate material comprising a single layer of heat-conductive material and a single layer of heat-insulative material. In certain particularly preferred embodiments the wrapper is formed of a laminate material comprising a single radially outer layer of heat-conductive material and a single radially inner layer of heat-insulative material. For example, in one particularly preferred embodiment, the wrapper comprises a single radially outer layer of aluminium and a single radially inner layer of paper.

In other preferred embodiments the wrapper is formed of a single layer of heat-conductive material. For example, in one preferred embodiment, the wrapper comprises a single layer of aluminium.

The thickness of the wrapper is preferably between about 5 microns and about 100 microns, more preferably between about 5 microns and about 80 microns.

The wrapper preferably comprises one or more layers of heat-conductive material having a thickness of between about 2 microns and about 50 microns, more preferably between about 4 microns and about 30 microns.

In certain particularly preferred embodiments, the wrapper comprises a single radially outer layer of aluminium having a thickness of between about 5 microns and about 7 microns and a single radially inner layer of paper.

In other preferred embodiments, the wrapper comprises a single layer of aluminium having a thickness of between about 15 microns and about 25 microns.

The wrapper circumscribes at least a rear portion of the combustible heat source and at least a front portion of the aerosol-forming substrate.

The position and extent of the wrapper relative to the combustible heat source and the aerosol-forming substrate may be adjusted in order to control heating of the aerosol-forming substrate during smoking. In particular, the extent of the wrapper relative to the combustible heat source and the aerosol-forming substrate in the upstream direction and the downstream direction may be adjusted in order to adjust the aerosol delivery profile of the smoking article.

In certain embodiments, the wrapper does not circumscribe a front portion of the combustible heat source.

In other embodiments, the wrapper circumscribes the entire length of the combustible heat source. In such embodiments, the wrapper preferably comprises a cut, a line of perforations or other line of weakness, or a tear tape to allow a portion of the wrapper circumscribing a front portion of the combustible heat source to be removed by a consumer prior to ignition of the combustible heat source.

The rear portion of the combustible heat source circumscribed by the wrapper is preferably between about 2 mm and about 8 mm in length, more preferably between about 3 mm and about 5 mm in length.

The front portion of the combustible heat source not circumscribed by the wrapper is preferably between about 4 mm and about 15 mm in length, more preferably between about 5 mm and about 8 mm in length.

In certain preferred embodiments the wrapper circumscribes the entire length of the aerosol-forming substrate. In such embodiments, the downstream end of the wrapper may be aligned with the downstream end of the aerosol-forming substrate. Alternatively, the wrapper may extend beyond the aerosol-forming substrate in the downstream direction.

However, in other embodiments the wrapper may circumscribe only a front portion of the aerosol-forming substrate. In such embodiments, the aerosol-forming substrate extends beyond the wrapper in the downstream direction.

The outer surface of the wrapper may be visible on the exterior of the smoking article. That is, the outer surface of the wrapper may form all or part of the outer surface of the smoking article.

For example, in certain embodiments the wrapper may comprise a single radially outer layer of heat-conductive material, such as aluminium, and a single radially inner layer of heat-insulative material, such as paper, wherein the radially outer layer of heat-conductive material is visible on the exterior of the smoking article.

Alternatively, smoking articles according to the invention may further comprise one or more radially outer layers of material overlying the wrapper. For example, smoking articles according to the invention may further comprise one or more layers of adhesive, heat-conductive material (such as aluminium), heat-insulative material (such as paper), other wrapping material or a combination thereof circumscribing the wrapper.

For example, in certain embodiments the wrapper may be an inner wrapper comprising a single layer of heat-conductive material, such as aluminium, and the smoking article may be circumscribed by an outer wrapper comprising a single radially outer layer of heat-conductive material, such as aluminium, and a single radially inner layer of heat-insulative material, such as paper.

Smoking articles according to the invention preferably comprise a blind combustible heat source.

As used herein, the term 'blind' is used to describe a combustible heat source that does not include any airflow channels extending from the front end face to the rear end face of the combustible carbonaceous heat source. As used herein, the term 'blind' is also used to describe a combustible heat source including one or more airflow channels extending from the front end face of the combustible heat source to the rear end face of the combustible carbonaceous heat source, wherein a non-combustible substantially air impermeable barrier between the rear end face of the combustible heat source and the aerosol-forming substrate barrier prevents air from being drawn along the length of the combustible heat source through the one or more airflow channels.

As used herein, the term 'airflow channel' is used to describe a channel extending along the length of a combustible heat source through which air may be drawn for inhalation by a user.

Smoking articles according to the invention comprising blind combustible heat sources comprise one or more air inlets downstream of the combustible heat source for drawing air into one or more airflow pathways along which air may be drawn through the smoking article for inhalation by a user.

As used herein, the term 'air inlet' is used to describe a hole, slit, slot or other aperture through which air may be drawn into the smoking article.

In use, air drawn along the one or more airflow pathways of smoking articles according to the invention comprising a blind combustible heat source for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through smoking articles according to the invention during use thereof. This is particularly advantageous where the blind combustible heat source comprises one or more additives to aid ignition or combustion of the blind combustible heat source.

In smoking articles according to the invention comprising a blind combustible heat source, heat transfer from the blind combustible heat source to the aerosol-forming substrate occurs primarily by conduction and heating of the aerosol-forming substrate by forced convection is minimised or reduced. This may advantageously help to minimise or reduce the impact of a user's puffing regime on the composition of the mainstream aerosol of smoking articles according to the invention.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

Alternatively, smoking articles according to the invention may comprise a non-blind combustible heat source.

Smoking articles according to the invention may comprise a non-blind combustible heat source.

As used herein, the term 'non-blind' is used to describe a combustible heat source including at least one airflow channel extending from the front end face to the rear end face of the combustible heat source.

As used herein, the term 'enclosed' is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

Smoking articles according to the invention may, for example, comprise non-blind combustible heat source including one, two or three airflow channels extending from the front face to the rear end face of the combustible heat source.

In certain embodiments, smoking articles according to the invention may comprise non-blind combustible heat sources including a single airflow channel extending from the front face to the rear end face of the combustible heat source. For example, smoking articles according to the invention may comprise non-blind combustible heat source including a single substantially central or axial airflow channel extending from the front face to the rear end face of the combustible heat source.

It will be appreciated that in addition to one or more airflow channels through which air may be drawn for inhalation by a user, smoking articles according to the invention may comprise non-blind combustible heat sources comprising one or more closed or blocked passageways through which air may not be drawn for inhalation by a user.

For example, smoking articles according to the invention may comprise non-blind combustible heat sources comprising one or more airflow channels extending from the front face to the rear end face of the combustible heat source and one or more closed passageways that extend from the front face of the non-blind combustible heat source only part way along the length combustible heat source.

The inclusion of one or more closed air passageways increases the surface area of the non-blind combustible heat source that is exposed to oxygen from the air and may advantageously facilitate ignition and sustained combustion of the non-blind combustible heat source.

Smoking articles according to the invention comprising a non-blind combustible heat source may further comprise a non-combustible substantially air impermeable barrier between the non-blind combustible heat source and the one or more airflow channels extending from the front face to the rear end face of the non-blind combustible heat source.

Advantageously, inclusion of a non-combustible substantially air impermeable barrier between the non-blind combustible heat source and the one or more airflow channels extending from the front face to the rear end face of the non-blind combustible heat source may substantially prevent or inhibit combustion and decomposition products formed during ignition and combustion of the non-blind combustible heat source from entering air drawn into the smoking article through the one or more airflow channels as the drawn air passes through the one or more airflow channels. This is particularly advantageous where the non-blind combustible heat source comprises one or more additives to aid ignition or combustion of the non-blind combustible heat source.

The barrier between the non-blind combustible heat source and the one or more airflow channels may be adhered or otherwise affixed to the non-blind combustible heat source.

In certain preferred embodiments, the barrier comprises a non-combustible substantially air impermeable barrier coating provided on an inner surface of the one or more airflow channels. In such embodiments, preferably the barrier comprises a barrier coating provided on at least substantially the entire inner surface of the one or more airflow channels. More preferably, the barrier comprises a barrier coating provided on the entire inner surface of the one or more airflow channels.

As used herein, the term 'coating' is used to describe a layer of material that covers and is adhered to the combustible heat source.

In other embodiments, the barrier coating may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the non-blind combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where the barrier comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In certain preferred embodiments, the barrier coating is applied to the inner surface of the one or more airflow channels by the process described in WO-A2-2009/074870 as the combustible heat source is extruded.

Smoking articles according to the invention may further comprise a non-combustible substantially air impermeable barrier between the rear end face of the combustible heat source and the aerosol-forming substrate.

Where smoking articles according to the invention comprise a non-blind combustible heat source and a non-combustible, substantially air impermeable barrier between the rear end face of the combustible heat source and the aerosol-forming substrate, the barrier should allow air entering the smoking article through the one or more airflow channels extending from the front face to the rear end face of the non-blind combustible heat source to be drawn downstream through the smoking article.

The barrier may abut one or both of the rear end face of the combustible heat source and the aerosol-forming substrate. Alternatively, the barrier may be spaced apart from one or both of the rear end face of the combustible heat source and the aerosol-forming substrate.

The barrier may be adhered or otherwise affixed to one or both of the rear end face of the combustible heat source and the aerosol-forming substrate.

In certain preferred embodiments, the barrier comprises a non-combustible substantially air impermeable barrier coating provided on the rear end face of the combustible heat source. In such embodiments, preferably the barrier comprises a barrier coating provided on at least substantially the entire rear end face of the combustible heat source. More preferably, the barrier comprises a barrier coating provided on the entire rear end face of the combustible heat source.

Advantageously, the barrier may limit the temperature to which the aerosol-forming substrate is exposed during ignition and combustion of the combustible heat source, and so help to avoid or reduce thermal degradation or combustion of the aerosol-forming substrate during use of the smoking article. This is particularly advantageous where the combustible heat source comprises one or more additives to aid ignition of the combustible heat source.

The aerosol-forming substrate may abut the rear end face of the combustible heat source or a non-combustible substantially air impermeable barrier coating provided on the rear end face of the combustible heat source.

In other embodiments, the aerosol-forming substrate may be spaced apart from the rear end face of the combustible heat source or a non-combustible substantially air impermeable barrier coating provided on the rear end face of the combustible heat source. That is, there may be a space or gap between the aerosol-forming substrate and the rear end face of the combustible heat source.

Advantageously, inclusion of a non-combustible substantially air impermeable barrier between the rear end face of the combustible heat source and the aerosol-forming substrate may substantially prevent or inhibit migration of components of the aerosol-forming substrate to the combustible heat source during storage of the smoking article.

Alternatively or in addition, inclusion of a non-combustible substantially air impermeable barrier between the rear end face of the combustible heat source and the aerosol-forming substrate of smoking articles according to the invention may advantageously substantially prevent or inhibit migration of components of the aerosol-forming substrate to the combustible heat source during use of the smoking article.

Inclusion of a non-combustible substantially air impermeable barrier between the rear end face of the combustible heat source and the aerosol-forming substrate is particularly advantageous where the aerosol-forming substrate comprises at least one aerosol-former.

In such embodiments, inclusion of a non-combustible substantially air impermeable barrier between the rear end face of the combustible heat source and the aerosol-forming substrate of smoking articles according to the invention may advantageously prevent or inhibit migration of the at least one aerosol-former from the aerosol-forming substrate to the combustible heat source during storage and use of the smoking article. Decomposition of the at least one aerosol-former during use of the smoking article may thus be advantageously substantially avoided or reduced.

Depending upon the desired characteristics and performance of the smoking article, the non-combustible substantially air impermeable barrier between the rear end face of the combustible heat source and the aerosol-forming substrate may have a low thermal conductivity or a high thermal conductivity. In certain embodiments, the barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In certain preferred embodiments, the barrier comprises a clay coating comprising a 50/50 mixture of bentonite and kaolinite provided on the rear end face of the combustible heat source. In other preferred embodiments, the barrier comprises a glass coating, more preferably a sintered glass coating, provided on the rear end face of the combustible heat source.

In certain particularly preferred embodiments, the barrier comprises an aluminium coating provided on the rear end face of the combustible heat source.

Preferably, the barrier has a thickness of at least about 10 microns.

Due to the slight permeability of clays to air, in embodiments where the barrier comprises a clay coating provided on the rear end face of the combustible heat source, the clay coating more preferably has a thickness of at least about 50 microns, and most preferably of between about 50 microns and about 350 microns.

In embodiments where the barrier is formed from one or more materials that are more impervious to air, such as aluminium, the barrier may be thinner, and generally will preferably have a thickness of less than about 100 microns, and more preferably of about 20 microns.

In embodiments where the barrier comprises a glass coating provided on the rear end face of the combustible heat source, the glass coating preferably has a thickness of less than about 200 microns.

The thickness of the barrier may be measured using a microscope, a scanning electron microscope (SEM) or any other suitable measurement methods known in the art.

Where the barrier comprises a barrier coating provided on the rear end face of the combustible heat source, the barrier coating may be applied to cover and adhere to the rear end face of the combustible heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear end face of the combustible heat source, and applying it to the rear end face of the combustible heat source to cover and adhere to at least substantially the entire rear end face of the combustible heat source. Alternatively, the barrier coating may be cut or otherwise machined after it is applied to the rear end face of the combustible heat source. In one preferred embodiment, aluminium foil is applied to the rear end face of the combustible heat source by gluing or pressing it to the combustible heat source, and is cut or otherwise machined so that the aluminium foil covers and adheres to at least substantially the entire rear end face of the combustible heat source, preferably to the entire rear end face of the combustible heat source.

In another preferred embodiment, the barrier coating is formed by applying a solution or suspension of one or more suitable coating materials to the rear end face of the combustible heat source. For example, the barrier coating may be applied to the rear end face of the combustible heat source by dipping the rear end face of the combustible heat source in a solution or suspension of one or more suitable coating materials or by brushing or spray-coating a solution or suspension or electrostatically depositing a powder or powder mixture of one or more suitable coating materials onto the rear end face of the combustible heat source. Where the barrier coating is applied to the rear end face of the combustible heat source by electrostatically depositing a powder or powder mixture of one or more suitable coating materials onto the rear end face of the combustible heat source, the rear end face of the combustible heat source is preferably pre-treated with water glass before electrostatic deposition. Preferably, the barrier coating is applied by spray-coating.

The barrier coating may be formed through a single application of a solution or suspension of one or more suitable coating materials to the rear end face of the combustible heat source. Alternatively, the barrier coating may be formed through multiple applications of a solution or suspension of one or more suitable coating materials to the rear end face of the combustible heat source. For example, the barrier coating may be formed through one, two, three, four, five, six, seven or eight successive applications of a solution or suspension of one or more suitable coating materials to the rear end face of the combustible heat source.

Preferably, the barrier coating is formed through between one and ten applications of a solution or suspension of one or more suitable coating materials to the rear end face of the combustible heat source.

After application of the solution or suspension of one or more coating materials to the rear end face thereof, the combustible heat source may be dried to form the barrier coating.

Where the barrier coating is formed through multiple applications of a solution or suspension of one or more suitable coating materials to the rear end face thereof, the combustible heat source may need to be dried between successive applications of the solution or suspension.

Alternatively or in addition to drying, after application of a solution or suspension of one or more coating materials to the rear end face of the combustible heat source, the coating material on the combustible heat source may be sintered in order to form the barrier coating. Sintering of the barrier coating is particularly preferred where the barrier coating is a glass or ceramic coating. Preferably, the barrier coating is sintered at a temperature of between about 500° C. and about 900° C., and more preferably at about 700° C.

Smoking articles according to the invention may comprise one or more first air inlets around the periphery of the aerosol-forming substrate.

Where smoking articles according to the invention comprise one or more first air inlets around the periphery of the aerosol-forming substrate, in use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

During puffing by a user, the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of the smoking article.

In certain preferred embodiments, the one or more first air inlets are located proximate to the downstream end of the aerosol-forming substrate.

Alternatively or in addition to one or more first air inlets, in embodiments in which the aerosol-forming substrate is spaced apart from the rear end face of the combustible heat source, smoking articles according to the invention may comprise one or more second air inlets between the rear end face of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the smoking article from the space between the combustible heat source and the aerosol-forming substrate and exits the smoking article through the proximal end thereof.

During puffing by a user, cool air drawn through the one or more second inlets between the rear end face of the combustible heat source and the aerosol-forming substrate may advantageously reduce the temperature of the aerosol-forming substrate. This may advantageously substantially prevent or inhibit spikes in the temperature of the aerosol-forming substrate during puffing by a user.

Alternatively or in addition to one or more first air inlets or one or more second air inlets, smoking articles according to the invention may comprise one or more third air inlets downstream of the aerosol-forming substrate.

It will be appreciated that smoking articles according to the invention may comprise one or more first air inlets around the periphery of the aerosol-forming substrate, or one or more second air inlets between the rear end face of the combustible heat source and the aerosol-forming substrate, or one or more third air inlets downstream of the aerosol-forming substrate, or any combination thereof.

The number, shape, size and location of the air inlets may be appropriately adjusted to achieve a good smoking performance.

The combustible heat source is preferably a solid combustible heat source.

The combustible heat source preferably has a length of between about 7 mm and about 17 mm, more preferably of between about 7 mm and about 15 mm, most preferably of between about 7 mm and about 13 mm.

The combustible heat source preferably has a diameter of between about 5 mm and about 9 mm, more preferably of between about 7 mm and about 8 mm.

The combustible heat source is preferably of substantially uniform diameter.

The combustible heat source may comprise any suitable combustible fuel.

The combustible heat source is preferably a carbonaceous heat source.

As used herein, the term 'carbonaceous' is used to describe a combustible heat source comprising carbon.

Combustible carbonaceous heat sources for use in smoking articles according to the invention preferably have a carbon content of at least about 35 percent, more preferably of at least about 40 percent, most preferably of at least about 45 percent by dry weight of the combustible heat source. In certain embodiments, combustible carbonaceous heat sources for use in smoking articles according to the invention may have a carbon content of at least about 60 percent, or at least about 70 percent, or at least about 80 percent by dry weight of the combustible carbonaceous heat source.

Smoking articles according to the invention may comprise combustible carbonaceous heat sources formed from one or more suitable carbon-containing materials.

One or more binders may be combined with the one or more carbon-containing materials. Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Where smoking articles according to the invention comprise a barrier coating provided on the rear end face of the combustible heat source, such additives may be incorporated in the combustible heat source prior to or after application of the barrier coating to the rear end face of the combustible heat source.

In certain preferred embodiments, the combustible heat source is a combustible carbonaceous heat source comprising carbon and at least one ignition aid. In one preferred embodiment, the combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the combustible carbonaceous heat source, where the rate of release of one or both of energy and oxygen by the material is not ambient oxygen diffusion limited. In other words, the rate of release of one or both of energy and oxygen by the material during ignition of the combustible carbonaceous heat source is largely independent of the rate at which ambient oxygen can reach the material. As used herein, the term 'ignition aid' is also used to denote an elemental metal that releases energy during ignition of the combustible carbonaceous heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible carbonaceous heat source, such alkali metal burn salts do not release enough energy during ignition of a combustible carbonaceous heat source to produce an acceptable aerosol during early puffs.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides.

Where smoking articles according to the invention comprise a non-blind combustible carbonaceous heat source, the inclusion of a non-combustible substantially air impermeable barrier between the one or more airflow channels and the non-blind combustible carbonaceous heat source may advantageously substantially prevent or inhibit such decomposition and reaction products from entering air drawn into smoking articles according to the invention through the one or more airflow channels as the drawn air passes through the one or more airflow channels.

The inclusion of a non-combustible substantially air impermeable barrier between the rear end face of the combustible carbonaceous heat source and the aerosol-forming substrate may also advantageously substantially prevent or inhibit such decomposition and reaction products from entering air drawn through smoking articles according to the invention.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired between about 700° C. and about 900° C.

Advantageously, combustible carbonaceous heat sources for use in smoking articles according to the invention have an apparent density of between about 0.6 g/cm$^3$ and about 1 g/cm$^3$.

Advantageously, combustible carbonaceous heat sources for use in smoking articles according to the invention have a mass of between about 300 mg and about 500 mg, more preferably of between about 400 mg and about 450 mg.

The aerosol-forming substrate may be a solid aerosol-forming substrate. The solid aerosol-forming substrate may comprise, for example, one or more of: powder, granules, pellets, shreds, spaghetti strands, strips or sheets of material capable of releasing volatile compounds in response to heating. The solid aerosol-forming substrate may be in loose form, or may be provided in a suitable container or cartridge.

Alternatively, the aerosol-forming substrate may comprise both solid and liquid components.

Preferably, the aerosol-forming substrate comprises nicotine. More preferably, the aerosol-forming substrate comprises tobacco.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm, more preferably of between about 6 mm and about 15 mm, most preferably of between about 7 mm and about 12 mm.

In certain preferred embodiments, the aerosol-forming substrate comprises a plug of tobacco-based material wrapped in a plug wrap. In certain particularly preferred embodiments, the aerosol-forming substrate comprises a plug of homogenised tobacco-based material wrapped in a plug wrap.

Smoking articles according to the invention may further comprise a cap configured to at least partially cover the front end face of the combustible heat source, wherein the cap is removable to expose the front end face of the combustible heat source prior to ignition of the combustible heat source. Advantageously, the cap protects the combustible heat source prior to use of the smoking article.

As used herein, the term 'cap' is used to describe a protective cover that substantially surrounds the distal end of the smoking article, including the front end face of the combustible heat source.

For example, smoking articles according to the invention may comprise a removable cap attached at a line of weakness to the distal end of the smoking article, wherein the cap comprises a cylindrical plug of material circumscribed by a wrapper as described in WO-A1-2014/086998.

Smoking articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of the smoking article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, air drawn into the smoking article passes through the at least one open-ended tubular hollow body as it passes downstream through the smoking article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Smoking articles according to the invention may have any desired length. For example, smoking articles according to the invention may have a total length of between about 65 mm and about 100 mm.

Smoking articles according to the invention may have any desired diameter. For example, smoking articles according to the invention may have a diameter of between about 5 mm and about 12 mm.

Smoking articles according to the invention may be arranged for insertion into a reusable holder having a mouthpiece. In such embodiments, the aerosol-forming substrate may be located at the downstream end of the smoking article. In such embodiments, the smoking article may comprise the combustible heat source, the aerosol forming substrate and the wrapper. Additional components, such as for example a transfer element, aerosol-cooling element, or filter as described above, may be provided for example as a part of the reusable holder.

In other embodiments in which the smoking article is arranged for insertion into a reusable holder having a mouthpiece, the smoking article may comprise one or more additional components, such as for example a transfer element, aerosol-cooling element, or filter as described above, downstream of the aerosol-forming substrate. Such additional components may for example be insertable into the reusable holder.

In embodiments in which the smoking article is arranged for insertion into a reusable holder having a mouthpiece, the smoking article may for example have a total length of between approximately 10 mm and approximately 100 mm.

Smoking articles according to the invention may be assembled using known methods and machinery.

All scientific and technical terms used herein have meanings commonly used in the art unless otherwise specified. The definitions provided herein are to facilitate understanding of certain terms used frequently herein.

The terms 'preferred' and 'preferably' refer to embodiments of the invention that may afford certain benefits, under certain circumstances. Particularly preferred are smoking articles according to the invention comprising combinations of preferred features. However, it will be appreciated that other embodiments may also be preferred, under the same or other circumstances. Furthermore, the recitation of one or more preferred embodiments does not imply that other embodiments are not useful, and is not intended to exclude other embodiments from the scope of the claims.

The smoking article according to an embodiment of the invention shown in FIG. 1 comprises a removable cap 100, a combustible carbonaceous heat source 102, an aerosol-forming substrate 104, a transfer element 106, an aerosol-cooling element 108, a spacer element 110, and a mouthpiece 112 in abutting coaxial alignment. The combustible carbonaceous heat source 102 has a front end face 114 and an opposed rear end face 116.

As shown in FIG. 1, the removable cap 100, the combustible carbonaceous heat source 102, the aerosol-forming substrate 104 and the transfer element 106 are circumscribed by a co-laminated wrapper 120.

The combustible carbonaceous heat source 102 is a blind combustible carbonaceous heat source. As shown in FIG. 1, a non-combustible substantially air impermeable barrier 122 in the form of a disc of aluminium foil is provided between the rear end face 116 of the combustible carbonaceous heat source 102 and the aerosol-forming substrate 104. The barrier 122 is applied to the rear end face 116 of the combustible carbonaceous heat source 102 by pressing the disc of aluminium foil onto the rear end face 116 of the combustible carbonaceous heat source 102 and abuts the rear end face 116 of the combustible carbonaceous heat source 102 and the aerosol-forming substrate 104.

The aerosol-forming substrate 104 is located immediately downstream of the barrier 122 applied to the rear end face 116 of the combustible carbonaceous heat source 102. The aerosol-forming substrate 104 comprises a cylindrical plug of homogenised tobacco-based material 124 including an aerosol former such as, for example, glycerine, wrapped in plug wrap 126.

The transfer element 106 is located immediately downstream of the aerosol-forming substrate 104 and comprises a cylindrical open-ended hollow cellulose acetate tube 128.

The aerosol-cooling element 108 is located immediately downstream of the transfer element 106 and comprises a gathered sheet of biodegradable polymeric material such as, for example, polylactic acid.

The spacer element 110 is located immediately downstream of the aerosol-cooling element 108 and comprises a cylindrical open-ended hollow paper or cardboard tube.

The mouthpiece 112 is located immediately downstream of the spacer element 110. As shown in FIG. 1, the mouthpiece 112 is located at the proximal end of the smoking article and comprises a cylindrical plug of suitable filtration material 130 such as, for example, cellulose acetate tow of very low filtration efficiency, wrapped in filter plug wrap 132.

As shown in FIG. 1, the smoking article further comprises a band of tipping paper 134 circumscribing the mouthpiece 112, the spacer element 110, the aerosol-cooling element 108, and a downstream end portion of the co-laminated wrapper 120.

The removable cap 100 is located at the distal end of the smoking article and may comprise a central portion including a desiccant, such as glycerine, to absorb moisture. As shown in FIG. 1, a line of weakness 136 comprising a plurality of perforations that circumscribes the smoking article is provided in the co-laminated wrapper 120 overlying the combustible carbonaceous heat source 102 towards the rear end thereof. The removable cap 100 is circumscribed by and affixed to a portion of the co-laminated wrapper 120 upstream of the line of weakness 136. To use the smoking article, the user removes the removable cap 100 by radially compressing the cap 100 by pinching it between their thumb and finger. By compressing the removable cap 100, sufficient force is provided to the line of weakness 136 to locally break the co-laminated wrapper 120. The user may then remove the removable cap 100 and the portion of the co-laminated wrapper 120 upstream of the line of weakness 136 by twisting the removable cap 100 to break the remaining portion of the line of weakness 136. As shown in FIG. 2, removal of the removable cap 100 and the portion of the co-laminated wrapper 120 upstream of the line of weakness 136 exposes a front portion of the combustible carbonaceous heat source 102 enabling the user to ignite the combustible carbonaceous heat source 102.

As shown in FIG. 1, a circumferential arrangement of air inlets 138 is provided in the co-laminated wrapper 120 and the transfer element 106 towards the upstream end thereof to admit cool air (shown by dotted arrows in FIG. 1) into the transfer element 6.

The co-laminated wrapper 120 comprises a radially outer layer of heat-conductive material 140 and a radially inner layer of heat-insulative material 142. A plurality of inwardly extending projections (not shown), which are formed by embossing the co-laminated wrapper 120, are provided on the inner surface of the radially inner layer of heat-insulative material 142 of the co-laminated wrapper 120 overlying the combustible carbonaceous heat source 102.

In the embodiment shown in FIG. 1, the plurality of inwardly extending projections are in direct contact with the outer surface of the combustible carbonaceous heat source 102. However, it will be appreciated that in other embodiments of the invention (not shown), the plurality of inwardly extending projections may be radially separated from the combustible heat source by one or more intermediate components that are adhered or otherwise attached to the combustible heat source. It will also be appreciated that in other embodiments of the invention (not shown), a plurality of inwardly extending projections (not shown) may also be provided on the inner surface of the radially inner layer of heat-insulative material 142 of the co-laminated wrapper 120 overlying the aerosol-forming substrate 104.

In use, the user ignites the combustible carbonaceous heat source 102 which heats the aerosol-forming substrate 104 to produce an aerosol. When the user inhales on the mouthpiece 112 air (shown by dotted arrows in FIG. 1) is drawn into the transfer element 106 through the air inlets 138.

The front portion of the aerosol-forming substrate 104 is heated by conduction through the rear end face 116 of the combustible carbonaceous heat source 102 and the barrier 122, and the radially outer layer of heat-conductive material 140 of the wrapper 120.

The heating of the aerosol-forming substrate 104 by conduction releases glycerine and other volatile and semi-volatile compounds from the plug of homogenised tobacco-based material 124. The compounds released from the aerosol-forming substrate 104 form an aerosol that is entrained in the air drawn into the aerosol-forming substrate 104 of the smoking article 100 through the air inlets 138. The drawn air and entrained aerosol (shown by dashed arrows in FIG. 1) pass downstream through the interior of the cylindrical open-ended hollow cellulose acetate tube 128 of the transfer element 106, the aerosol-cooling element 108 and the spacer element 110, where they cool and condense. The cooled drawn air and entrained aerosol pass downstream through the mouthpiece 112 and are delivered to the user through the proximal end of the smoking article. The non-combustible substantially air impermeable barrier 122 on the rear end face 116 of the combustible carbonaceous heat source 102 isolates the combustible carbonaceous heat source 102 from air drawn through the smoking article such that, in use, air drawn through the smoking article does not come into direct contact with the combustible carbonaceous heat source 102.

In use, the radially outer layer of heat-conductive material 140 of the co-laminated wrapper 120 retains heat within the smoking article to help maintain the temperature of the aerosol-forming substrate 104 and so facilitate continued and enhanced aerosol delivery. In addition, the radially outer layer of heat-conductive material 140 of the co-laminated wrapper 120 transfers heat along the aerosol-forming substrate 104 so that heat is dispersed through a larger volume of the aerosol-forming substrate 104. This helps to provide a more consistent puff-by-puff aerosol delivery.

The plurality of inwardly extending projections provided on the inner surface of the radially inner layer of heat-insulative material 142 of the co-laminated wrapper 120 overlying the combustible carbonaceous heat source 102 advantageously help to retain the combustible carbonaceous heat source 102 in position within the smoking article and to maintain sufficient conductive heat transfer from the combustible carbonaceous heat source to the aerosol-forming substrate to achieve satisfactory performance of the smoking article.

EXAMPLES

Figure 5:
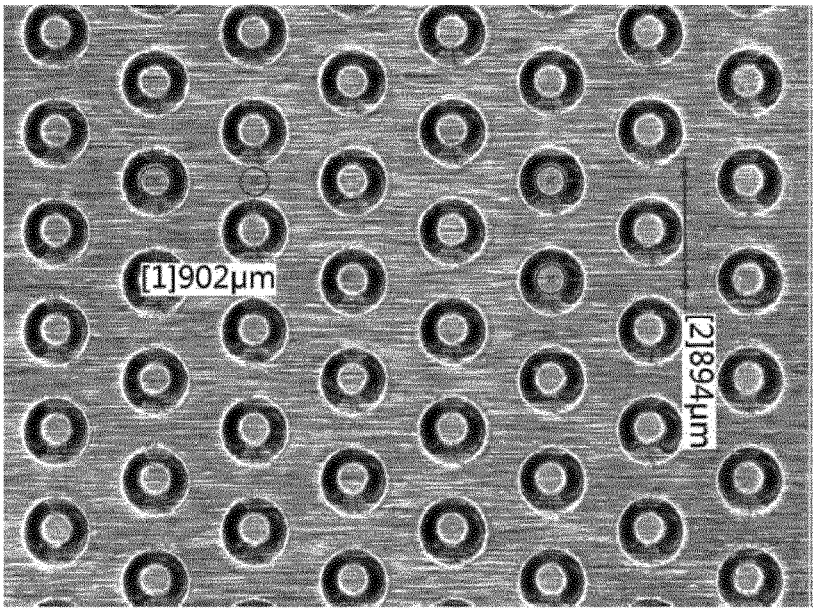
FIG. 5 shows an image of the wrapper of Example 3 obtained using an optical microscope with high magnification.
Figure 6:
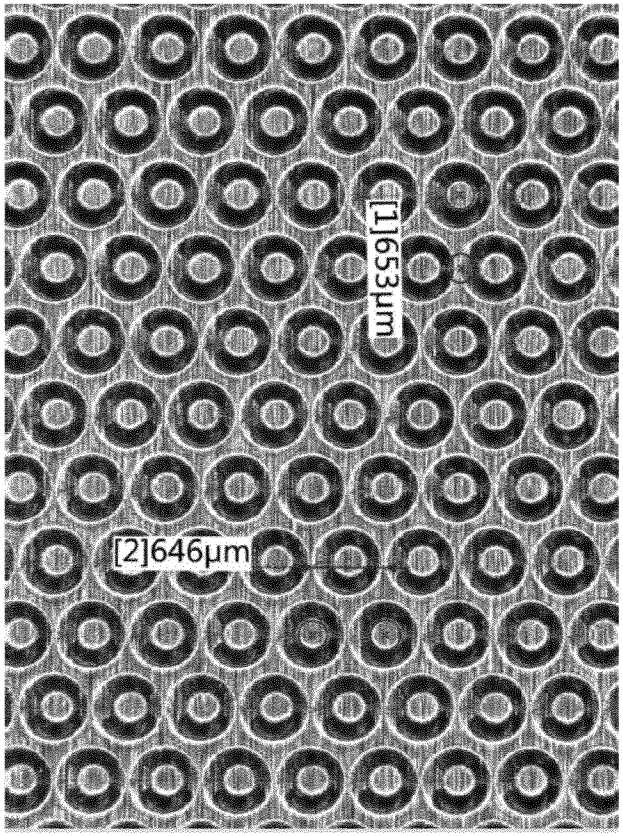
FIG. 6 shows an image of the wrapper of Example 4 obtained using an optical microscope with high magnification.

Smoking articles according to the embodiment of the invention shown in FIG. 1 are assembled having the dimensions shown in Table 1 using co-laminated wrappers comprising a radially outer layer of aluminium and a radially inner layer of paper. A plurality of inwardly extending projections is provided on the inner surface of the radially inner layer of paper of each co-laminated wrapper overlying the combustible heat source. The plurality of inwardly extending projections are formed by embossing the co-laminated wrappers. FIGS. 4, 5, and 6 are images obtained using an optical microscope with high magnification of the inner surface of the radially inner layer of paper of the co-laminated wrappers of Examples 2, 3, and 4 showing the plurality of inwardly extending projections. The percentage coverage, height, maximum cross-sectional area, separation and density of the plurality of projections provided on the inner surface of the radially inner layer of paper of the co-laminated wrappers of Examples 2, 3, and 4, measured by image processing of the images shown in FIGS. 4, 5, and 6, is shown in Table 2. The percentage coverage, height, maximum cross-sectional area, separation, and density of the plurality of projections provided on the inner surface of the radially inner layer of paper of the co-laminated wrapper of Example 1, measured by image processing of an image (not shown) obtained using an optical microscope with high magnification of the inner surface of the radially inner layer of paper of the co-laminated wrapper of Example 1, is also shown in Table 2.

TABLE 1

| Smoking article | |
|---|---|
| Overall length (mm) | 84 |
| Diameter (mm) | 7.8 |
| Removable cap | |
| Length (mm) | 5 |
| Combustible carbonaceous heat source | |
| Length (mm) | 9 |

TABLE 1-continued

| | |
|---|---|
| Aerosol-forming substrate | |
| Length (mm) | 8 |
| Aerosol former | Glycerine |
| Transfer element | |
| Length (mm) | 26 |
| Aerosol-cooling element | |
| Length (mm) | 12 |
| Spacer element | |
| Length (mm) | 12 |
| Mouthpiece | |
| Length (mm) | 12 |
| Tipping paper | |
| Length (mm) | 41 |
| Air inlets | |
| Distance of air inlets from upstream end of the smoking article (mm) | 27 |
| Co-laminated wrapper | |
| Thickness (microns) | 70.9 |
| Grammage (gsm) | 63 |
| Thickness of radially outer layer of aluminium (microns) | 6.3 |
| Grammage of radially outer layer of aluminium (gsm) | 18 |
| Thickness of radially inner layer of paper (microns) | 64.6 |
| Grammage of radially inner layer of paper (gsm) | 45 |
| Distance of line of weakness from front end face of the combustible heat source (mm) | 6 |

TABLE 2

| Example | Coverage (%) | Height (microns) | Maximum cross-sectional area ($mm^2$) | Separation (mm) | Density (projections per $mm^2$) |
|---|---|---|---|---|---|
| 1 | 14 | 75 | 0.28 | 0.81 | 0.50 |
| 2 | 20 | 80 | 0.27 | 0.57 | 0.75 |
| 3 | 33 | 85 | 0.27 | 0.31 | 1.24 |
| 3 | 65 | 80 | 0.27 | 0.06 | 2.37 |

The specific embodiments and examples described above illustrate but do not limit the invention. It is to be understood that other embodiments of the invention may be made and the specific embodiment and examples described herein are not exhaustive.

The invention claimed is:

1. A smoking article, comprising:

a combustible heat source;

an aerosol-forming, substrate downstream of the combustible heat source; and a wrapper circumscribing at least a rear portion of the combustible heat source and at least a front portion of the aerosol-forming substrate, wherein a plurality of inwardly extending projections are disposed on air inner surface of the wrapper overlying the combustible heat source, wherein the plurality of inwardly extending projections cover between about 10 percent and about 70 percent of a surface area of the inner surface of the wrapper overlying the combustible heat source, and wherein the plurality of inwardly extending projections provided on the inner surface of the wrapper are configured to maintain sufficient conductive heat transfer from the combustible heat source to the aerosol-forming substrate in order to optimize aerosol delivery by the smoking article.

2. The smoking article according to claim 1, wherein the plurality of inwardly extending projections cover between about 20 percent and about 65 percent of the surface area of the inner surface of the wrapper overlying the combustible heat source.

3. The smoking article according to claim 1, wherein the plurality of inwardly extending projections disposed on the inner surface of the wrapper are in direct contact with the combustible heat source.

4. The smoking article according to claim 1, wherein the plurality of inwardly extending projections disposed on the inner surface of the wrapper are radially separated from the combustible heat source by one or more layers of intermediate material.

5. The smoking article according to claim 1, wherein a height of each of the plurality of inwardly extending Projections is at least about 10 microns.

6. The smoking article according to claim 1, wherein a height of each of the plurality of inwardly extending projections is less than or equal to about 100 microns.

7. The smoking article according to claim 1, wherein a maximum cross-sectional area of each of the plurality of inwardly extending projections is between about 70 square microns and about 0.35 square millimeters.

8. The smoking article according to claim 1, wherein the plurality of inwardly extending projections are disposed on the inner surface of the wrapper in a pattern having a density of at least about 0.5 inwardly extending projections per square millimeter.

9. The smoking article according to claim 1, wherein the plurality of inwardly extending projections are disposed on an inner surface of the wrapper overlying at least about 25 percent of a length of the combustible heat source.

10. The smoking article according to claim 1, further comprising a plurality of inwardly extending projections on an inner surface of the wrapper overlying the aerosol-forming substrate.

11. The smoking article according to claim 1, wherein the plurality of inwardly extending projections are conical frustums or pyramidal frustums.

12. The smoking article according to claim 1, wherein the plurality of inwardly extending projections are formed by deforming the wrapper.

13. The smoking article according to claim 12, wherein the plurality of inwardly extending projections are formed by embossing, stamping, or pressing the wrapper.

14. The smoking article according to claim 1, wherein the wrapper is formed of a laminate material comprising one or more layers of heat-conductive material and one or more layers of heat-insulative material.

15. The smoking article according to claim 14, wherein the wrapper is formed of a laminate material comprising a single outer layer of heat-conductive material and a single inner layer of heat-insulative material.

* * * * *